US007639826B1

(12) United States Patent
Azima et al.

(10) Patent No.: US 7,639,826 B1
(45) Date of Patent: Dec. 29, 2009

(54) BENDING WAVE PANEL LOUDSPEAKER

(75) Inventors: Henry Azima, Huntingdon (GB); Neil Geoffrey Harris, Huntingdon (GB); Denis Morecroft, Huntingdon (GB); Mark Starnes, Huntingdon (GB); Martin Colloms, Huntingdon (GB); Paul Burton, Huntingdon (GB)

(73) Assignee: New Transducers Limited, Huntingdon Cambridgeshire (GB)

( * ) Notice: Subject to any disclaimer, the term of this patent is extended or adjusted under 35 U.S.C. 154(b) by 285 days.

(21) Appl. No.: 10/584,490

(22) PCT Filed: Jan. 6, 2005

(86) PCT No.: PCT/GB2005/000020

§ 371 (c)(1),
(2), (4) Date: Aug. 25, 2006

(87) PCT Pub. No.: WO2005/067344

PCT Pub. Date: Jul. 21, 2005

Related U.S. Application Data

(60) Provisional application No. 60/534,979, filed on Jan. 9, 2004.

(30) Foreign Application Priority Data

Jan. 8, 2004 (GB) ..... 0400323.2

(51) Int. Cl.
*H04R 25/00* (2006.01)

(52) U.S. Cl. ..... 381/152; 381/431

(58) Field of Classification Search ..... 381/152, 381/431

See application file for complete search history.

(56) References Cited

U.S. PATENT DOCUMENTS

| | | | | |
|---|---|---|---|---|
| 6,332,029 | B1 * | 12/2001 | Azima et al. | 381/152 |
| 7,403,628 | B2 * | 7/2008 | Murray | 381/152 |
| 2001/0033669 | A1 * | 10/2001 | Bank et al. | 381/152 |
| 2004/0240687 | A1 * | 12/2004 | Graetz | 381/152 |
| 2006/0029240 | A1 * | 2/2006 | Bank et al. | 381/152 |

FOREIGN PATENT DOCUMENTS

GB 2 142 429 A 1/1985

(Continued)

*Primary Examiner*—Huyen D Le
*Assistant Examiner*—Ryan C Robinson
(74) *Attorney, Agent, or Firm*—Roylance, Abrams, Berdo & Goodman, L.L.P.

(57) ABSTRACT

From one aspect, the invention is a method of making a bending wave panel loudspeaker, comprising rigidly coupling a lever to a panel edge or marginal portion such that the lever extends at an angle to the plane of the panel, coupling a bending wave exciter to the lever whereby bending wave energy is coupled to the panel to produce an acoustic output when the exciter is fed with a signal and supporting the panel on a suspension positioned outboard of the lever. From another aspect the invention is a bending wave panel-form loudspeaker having a lever rigidly coupled to a marginal portion or edge of the panel, a vibration exciter coupled to the lever to apply bending wave energy to the panel to produce an acoustic output and a panel suspension positioned outboard of the lever. From a further aspect, the invention is a small electronic device, e.g. a mobile telephone or PDA, having a display screen, and a transparent protective cover over the display screen, wherein the transparent protective cover is a loudspeaker as described above.

27 Claims, 8 Drawing Sheets

FOREIGN PATENT DOCUMENTS

| | | | |
|---|---|---|---|
| WO | WO 97/04842 | A1 | 2/1997 |
| WO | WO 97/09842 | A2 | 3/1997 |
| WO | WO 99/37121 | A1 | 7/1999 |
| WO | WO 00/13464 | A | 3/2000 |

* cited by examiner

PRIOR ART

BENDING WAVE PANEL LOUDSPEAKER

This application claims the benefit of U.S. provisional application No. 60/534,979, filed Jan. 9, 2004.

TECHNICAL FIELD

The invention relates to a method and apparatus for applying force to loudspeaker diaphragms of the bending wave panel-form kind, and more particularly to resonant bending wave loudspeakers e.g. of the kind described in International Application WO97/04842 and known as Distributed Mode Loudspeakers.

The invention relates more particularly, but not exclusively, to bending wave acoustic diaphragms applicable to small electronic devices such as mobile telephones, PDAs and the like which have a transparent plastics cover or protector over a display screen section and where it is valuable to combine the protective function of this cover with that of a bending wave loudspeaker.

It is an object of the invention to increase the viewable area of a display screen.

BACKGROUND ART

It is known to drive a bending wave loudspeaker panel near its centre by exciter[s] providing out of plane forces, offering useful efficiency, see, for example, International Application WO97/09842 to the present applicants.

It is also known that a transparent bending wave diaphragm may be combined with a display, and driven near its periphery, with defined boundary conditions. In such devices, the excitation is normal to the panel diaphragm plane, i.e. out of plane. This excitation method unfortunately occupies a proportion of the overall panel area, see for example International Application WO00/02417 to the present applicants.

It is also known that a bending wave panel speaker may be driven by a bending moment where the driving force is applied using the principle of a fulcrum, such methods including the use of a right angle lever with a fulcrum or simple support positioned inboard of the lever, see International Application WO00/13464 to the present applicants.

It is an object of the invention to provide a method and means whereby a simple lever couple may be used to present bending forces to a bending wave panel.

DISCLOSURE OF INVENTION

From one aspect, the invention is a method of making a bending wave panel loudspeaker, comprising mechanically coupling a lever to a panel edge or marginal portion such that the lever extends at an angle to the plane of the panel, coupling a vibration exciter to the lever whereby bending wave energy is coupled to the panel to provide an acoustic output when the exciter is fed with a signal and supporting the panel on a suspension positioned outboard of the lever. The method may comprise selecting a resilient suspension.

The method may comprise arranging the lever to be in the form of a flange extending along the panel edge or along a marginal portion of the panel.

The method may comprise arranging the flange to extend part-way along the panel edge or marginal portion or to be co-extensive with the panel edge.

The method may comprise arranging levers or flanges on a pair of opposite edges or marginal portions of the panel, and coupling each lever or flange to a vibration exciter whereby the bending wave panel can be operated as a stereo device.

The method may comprise arranging a lever or flange on an adjacent edge or marginal portion of the panel, and coupling a vibration exciter to the lever or flange on the adjacent edge or marginal portion to provide an additional channel acoustic output.

The method may comprise driving the lever or flange into resonance by the associated vibration exciter.

The method may comprise selecting a resonant or distributed mode device as a vibration exciter.

The method may comprise positioning the exciter inboard of the lever or flange.

The method may comprise applying force to the lever or flange via the vibration exciter generally in the plane of the panel.

The method may comprise applying force to the lever or flange via the exciter generally normally to the plane of the panel. In this way the panel can also be operated in whole body mode at low frequencies.

The method may comprise providing the lever or flange with a return lip at its end remote from the panel, and coupling the vibration exciter to the return lip.

The method may comprise driving the bending wave panel into resonance by the or each exciter, or at least by one exciter where more than one is provided. The resonance may be of the distributed mode kind.

From another aspect, the invention is bending wave panel-form loudspeaker having a lever mechanically coupled to a marginal portion or edge of the panel, a vibration exciter coupled to the lever to apply bending wave energy to the panel to produce an acoustic output and a panel suspension positioned outboard of the lever. The panel suspension may be compliant, e.g. of resilient plastics.

The lever may be in the form of a flange extending along the panel edge or along a marginal portion of the panel. The flange may extend part-way along the panel edge or marginal portion or may be co-extensive with the panel edge.

Levers or flanges may be provided on a pair of opposite edges or marginal portions of the panel, each lever or flange being coupled to a vibration exciter whereby the loudspeaker may be operated as a stereo device.

A lever or flange may be provided on an adjacent edge or marginal portion of the panel, the lever or flange on the adjacent edge or marginal portion being coupled to a vibration exciter to provide a multiple channel acoustic output.

The lever or flange may be adapted to be driven into resonance by the associated vibration exciter.

The vibration exciter may be a resonant or a distributed mode device.

The exciter may be placed inboard of the lever or flange.

The vibration exciter is adapted to apply force to the lever or flange generally normal to the plane thereof, or alternatively the vibration exciter may be adapted to apply force to the lever or flange generally in the plane thereof. In this latter case, the panel may operate in whole body mode at low frequencies, and the lever or flange may comprise a return lip at its end remote from the panel, so that the vibration exciter may be coupled to the return lip.

The bending wave panel may be adapted to resonate to produce an acoustic output, and may be of the distributed mode kind.

From another aspect, the invention is a small electronic device having a display screen, a transparent protective cover over the display screen, and wherein the transparent protective cover is a loudspeaker as described above. The small electronic device may be a mobile telephone, PDA or the like.

Thus with the method and loudspeaker or electronic device of the present invention, a fulcrum or simple support about which the panel is deformed is not required, since bending force is applied to the panel entirely via a lever. Also, in the present invention, the suspension is not positioned inboard of the lever as is the case in the prior art noted above and is instead outboard of the lower and at or near the edge of the panel. In addition the suspension need not be of the kind to provide a simple suspension or fulcrum, and can instead be compliant, e.g. of resilient foam plastics. Any suitable electrodynamic exciter may be used. Particular embodiments may use a distributed mode actuator, or DMA as described in International Application WO01/54450 to the present applicants, which may be matched to the loudspeaker assembly. The exciter may be placed inboard of the lever coupler to save space. Inertial and grounded exciters may be used.

The bending wave panel may be freely supported along its edge or edges having an associated lever or flange. The suspension may be generally or locally adapted to provide boundary conditions which improve the performance. Such adaptations may aid modal density and/or adjust modal distribution. The lever coupler may have selected parameters chosen to add beneficial modes to the coupled system. The panel may have a curved profile, either simple or complex. The curvature may be selected with regard to stiffness and thickness of the panel to improve the performance.

The mechanical properties of the fixing stub for the exciter may be selected for matching, for example by choice of damping and/or compliance.

One way of compensating for low modal density and high mechanical impedance is by analysis and optimisation of the mechanical and geometric parameters of the lever itself. Where there is potential for modal action in the exciter itself, e.g. when using a DMA, the modality of the coupling lever can also be made to be part of the complete modal system.

Relevant lever parameters include: area mass-density, stiffness, dimensions, thickness, anisotropy of material, curvature, and stiffening ribs.

The lever may be integral with the panel, or attached with adhesive. In both cases the angle between the lever and the panel may be a right angle, but may also be any other angle that allows a bending or torsional moment to be transferred to the radiating panel.

Degrees of freedom for coupling the exciter fixing stub to the lever, the DMA element(s) of the exciter to the fixing stub and the location of the lever on the panel, the DMA element(s) on the stub and the stub on the lever may all be independently or interactively selected for desired coupling.

Space is at a premium in small electronic devices and technology solutions which reduce the space requirements and integrate functions into sub assemblies are highly valued. The solution of the present invention allows one or more signal channels. For example, stereo, two channel reproduction has substantial market value and performance may be enhanced for such small devices by the well known and various systems for signal processing to increase the perceived spatial effects in the reproduced sound. More than one sound channel and related channel exciter may be used to drive the panel diaphragm, e.g. using an opposed pair of levers on opposite edges of the panel. The channels may be electrically combined at lower frequencies where there is common information, to increase efficiency. The channels so combined may be kept separated at higher frequencies to maintain the spatial and perceived channel separation effects in the reproduced sound.

The invention provides a means to allow the maximum viewable area on a mobile communications device or PDA and permit stereo signal reproduction. The goal is 100% viewable area. At the same time it is an objective to allow a multi-channel signal to be reproduced without the expected loss of viewable area due to additional take-up of otherwise available display area caused by the requirement for more than one transducer.

Stereo audio output is in great demand and the performance advantage is evident, particularly in larger objects, but is also useful in smaller devices.

It is an object of the invention to provide stereo at an effective cost. This is achieved by integrating two or more signal channels into one loudspeaker assembly. This may have the additional advantage of one connector. The loudspeaker assembly may be further integrated with the display module, so as to minimise assembly time and cost.

It is a further object to provide a speaker system of one or more channels which occupies very little space, given that space is at a tremendous premium in PDAs.

This technology uniquely offers an unexpected degree of perceived spatiality in the reproduced sound-field, considering the small size of some of the possible implementations. This is the more so if signal processing is used to create the expanded stereo effects well known in the audio industry.

If this effect is considered, a comparison may be drawn between the subtended angle of stereo speakers on a small stereo TV listened to from a distance of 3.5 meters and a handheld stereo PDA/telephone, where the listening distance is 0.5 m.

BRIEF DESCRIPTION OF DRAWINGS

The invention is diagrammatically illustrated, by way of example, in the accompanying drawings, in which:—

BEST MODES FOR CARRYING OUT THE INVENTION

Figure 1:
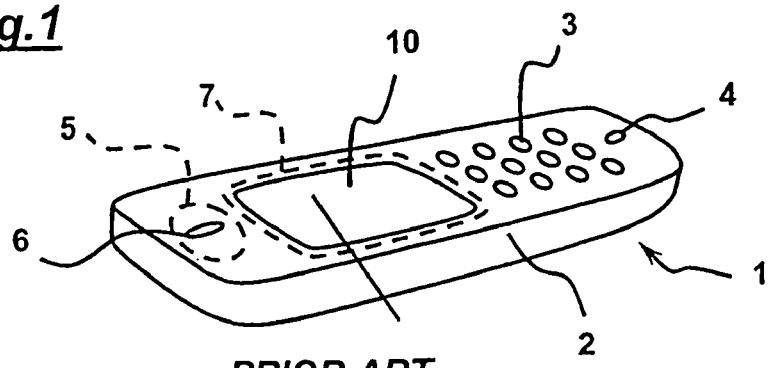
FIG. 1 is a perspective view of a prior art mobile telephone.

In FIG. 1 there is shown a prior art mobile telephone handset (1) comprising a housing (2), a keyboard (3), a microphone (4), and a micro speaker (5) and its associated sound radiation aperture (6). There is also a display screen (10) viewable through a protective transparent cover (7). The display screen cover (7) is slightly larger than the viewable area of the screen (10) which is defined by a corresponding aperture in the housing (2).

Figure 2:
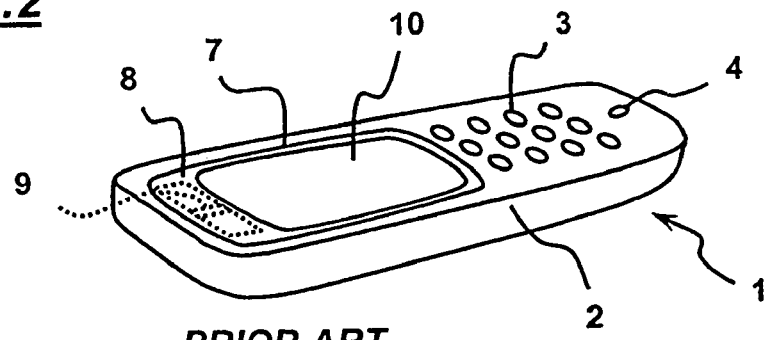
PRIOR ART Fig.2
FIG. 2 is a perspective view of another prior art mobile telephone.

In FIG. 2 there is shown a prior art mobile telephone handset (1) where the transparent display screen cover (7) has a marginal region (8) fitted with an electrodynamic exciter (9) which drives the cover in bending wave vibration to radiate sound. The cover thus acts as a resonant panel-form speaker. Such an arrangement is described in International Application WO00/02417. The exciter (9) may be a beam type piezo modal actuator, e.g. of the kind described in International Application WO01/54450.

Figure 3:
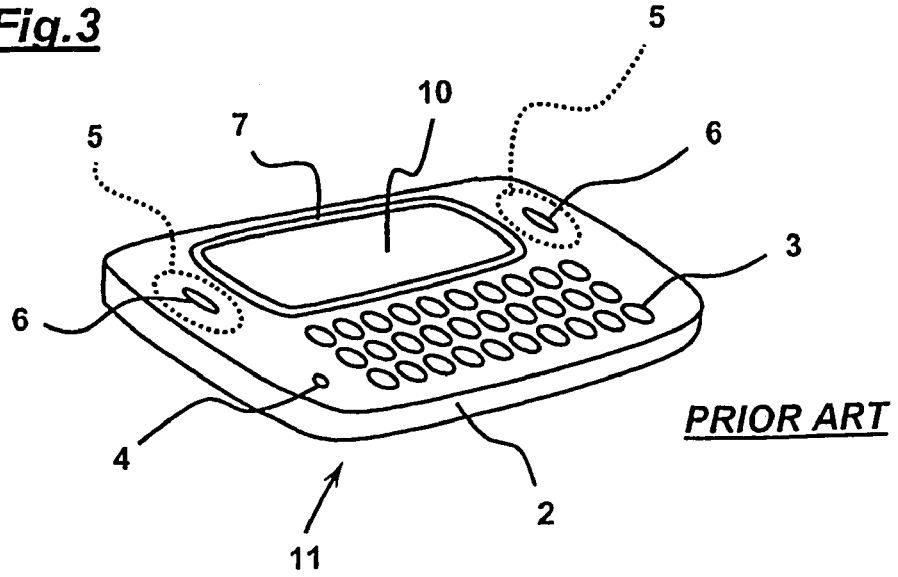
PRIOR ART Fig.3
FIG. 3 is a perspective view of a prior art so-called PDA or personal digital assistant.

FIG. 3 shows a PDA (11), that is a personal data device, according to the prior art with a large display screen area (10) and two sound reproducing channels (5), here configured for stereo sound output.

Figure 4:
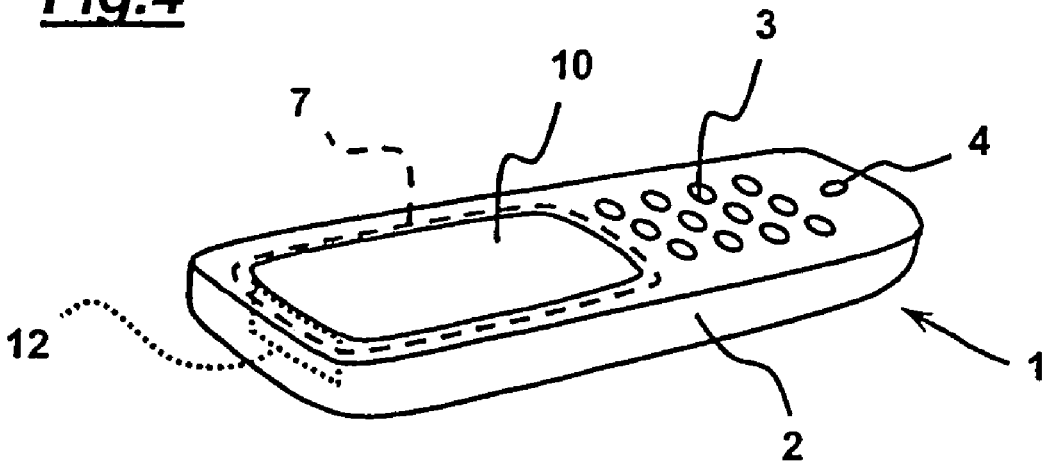
FIG. 4 is a perspective view of an embodiment of mobile telephone of the present invention.

FIG. 4 shows an embodiment of mobile telephone (1) according to the present invention and incorporating a lever couple mechanism (12) for actuating the loudspeaker described more fully below. The viewable area of the display (10) is significantly enhanced by use of the lever couple mechanism (12) to excite the sound radiating cover (7) since the vibration exciter (not shown) is not attached directly to the flat (potentially viewable) surface of the cover in the manner shown in FIG. 2 above. Any suitable electrodynamic exciter may be used, while the DMA (distributed mode actuator) type of WO01/54450 is well suited due to its thin form factor. This allows it to be incorporated in to the compact loudspeaker and display assembly shown. The screen cover is 6.5 cm by 4.3 cm and the DMA beam is 3.6 cm long and 0.7 cm wide, and of negligible thickness.

Figure 5:
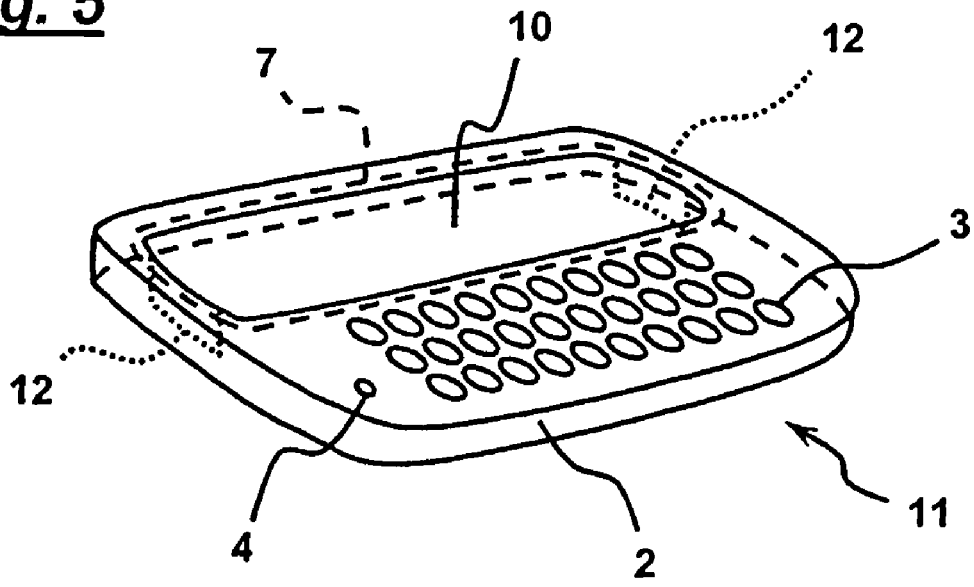
FIG. 5 is a perspective view of an embodiment of PDA of the present invention.

FIG. 5 shows an embodiment of PDA (11) of the present invention and illustrates how it may be enhanced with a larger display screen area (10) where the two-channel loudspeaker arrangement is combined with the transparent cover (7) over the display unit. The excitation of the bending wave loudspeaker cover is via two lever couple mechanisms disposed on opposed sides of the screen and located beneath the cover.

The present invention proposes a solution to the problem of providing a resonant bending wave panel-form loudspeaker for small electronic articles such as mobile telephone handsets, PDAs and the like where space is limited, and particularly in situations where the loudspeaker panel is transparent so as to form a cover in front of a visual display so that the vibration exciter must therefore be mounted to the edge of the panel. The solution involves coupling the vibration exciter to a member, e.g. a flange-like member which is rigidly fixed to the panel and extending at an angle, e.g. at right angles, thereto. Thus the vibration exciter applies force to the member which acts as a lever coupled to panel to excite the panel to resonate to produce an acoustic output.

Figure 6A:
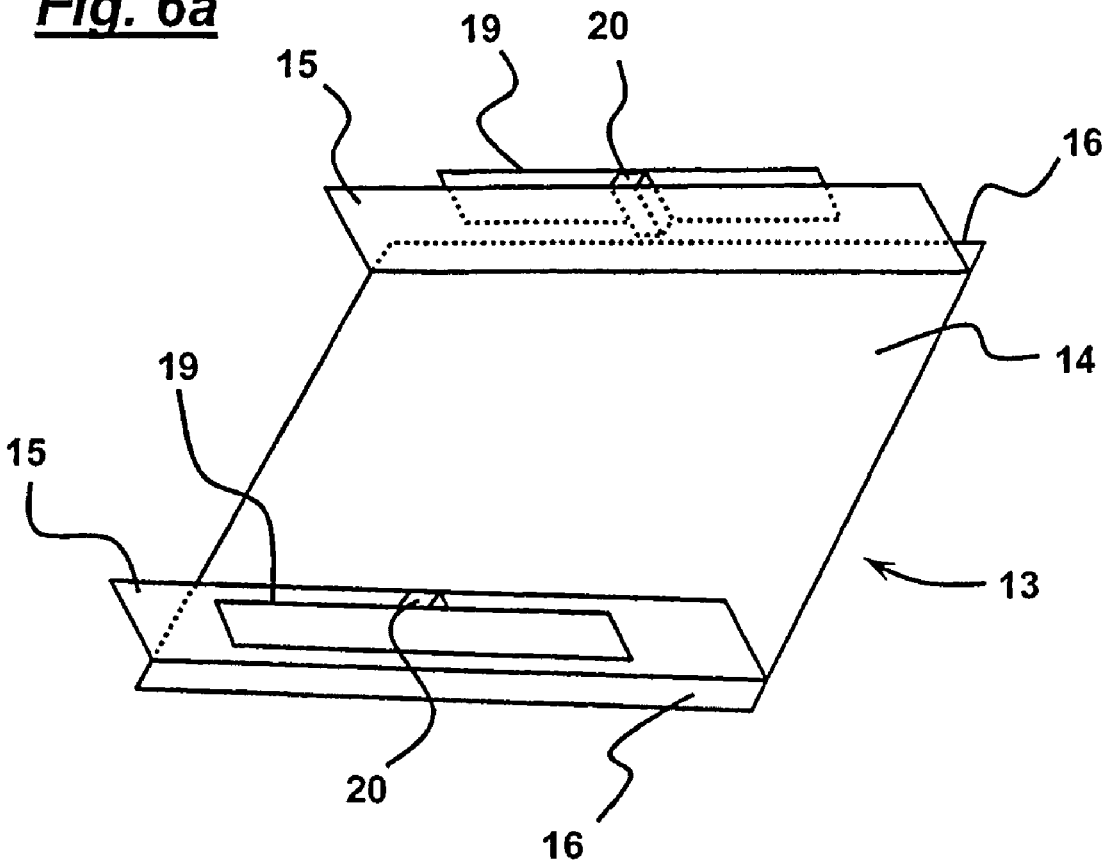
FIG. 6*a* is a perspective view of a first embodiment of bending wave panel loudspeaker of the invention.
Figure 6B:
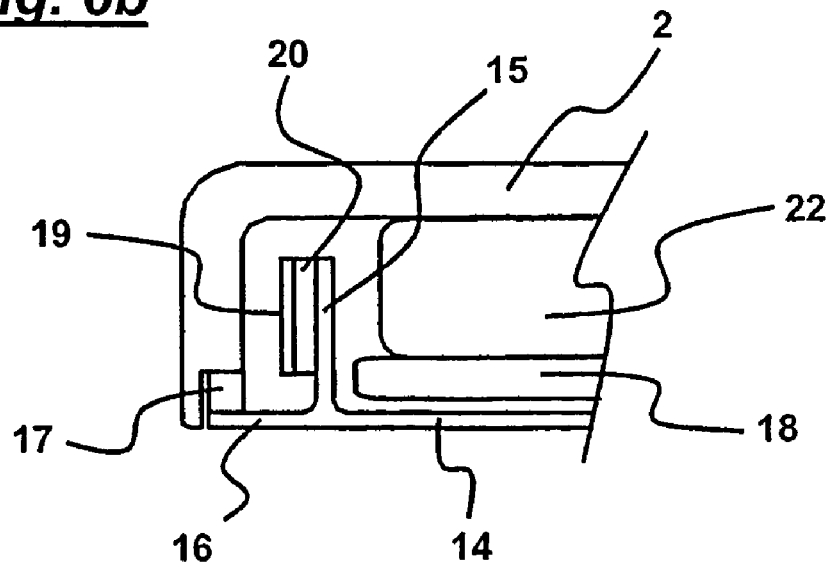
FIG. 6*b* is a scrap cross-sectional side view of the panel speaker of FIG. 6*a* mounted in a housing.

FIGS. 6*a* and 6*b* show a two-channel embodiment of bending wave panel speaker (13) comprising a rectangular panel-form acoustic radiator (14) e.g. the transparent cover over a visual display (18) in a mobile phone (1) of FIG. 4 or a PDA (11) of FIG. 5 and which is formed with upstanding flanges (15) extending along two opposed sides and rigidly attached to the radiator panel (14) to form lever couple mechanisms (12). The flanges (15) are positioned slightly inwards of the panel margins (16) to provide a region where a suspension (17) can be attached to secure the radiator (14) in position in the housing (2) of the mobile phone or other electronic device. The housing (2) contains the normal electronics (22) of the device.

Figure 6C:
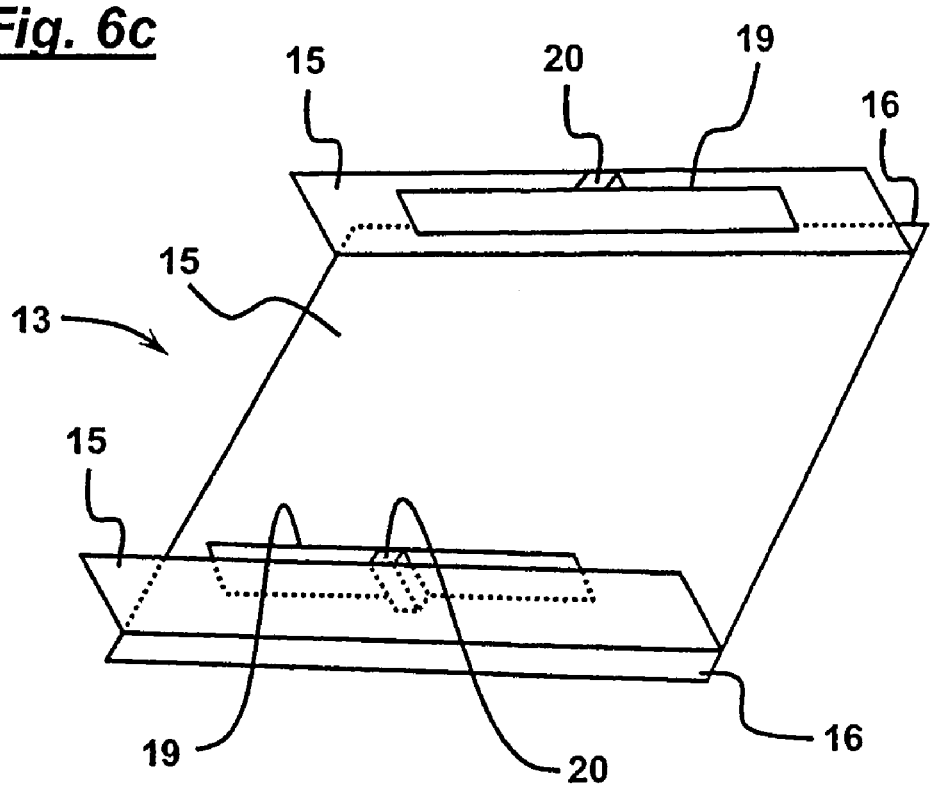
FIG. 6*c* is a perspective view of a second embodiment of bending wave panel loudspeaker of the invention.
Figure 6D:
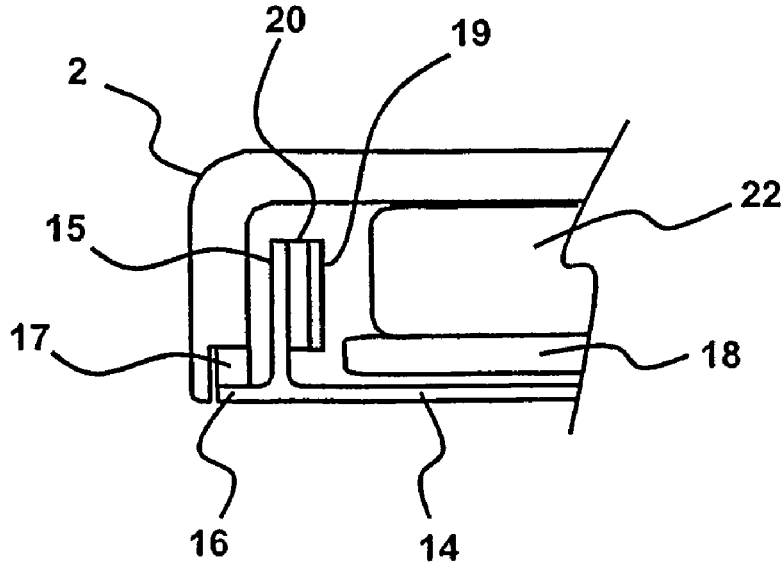
FIG. 6*d* is a scrap cross-sectional side view of the panel speaker of FIG. 6*c* mounted in a housing.

The lever couple flanges (15) extend substantially over the full length of the sides of the radiator (14) and beam exciters (19) are fixed to each of the flanges via a short stub (20). The exciters (19) may be mounted outboard of the lever couple (15) as shown in FIGS. 6*a* and 6*b* or inboard of the lever couple, as shown in FIGS. 6*c* and 6*d* to save even more space.

Figure 7:
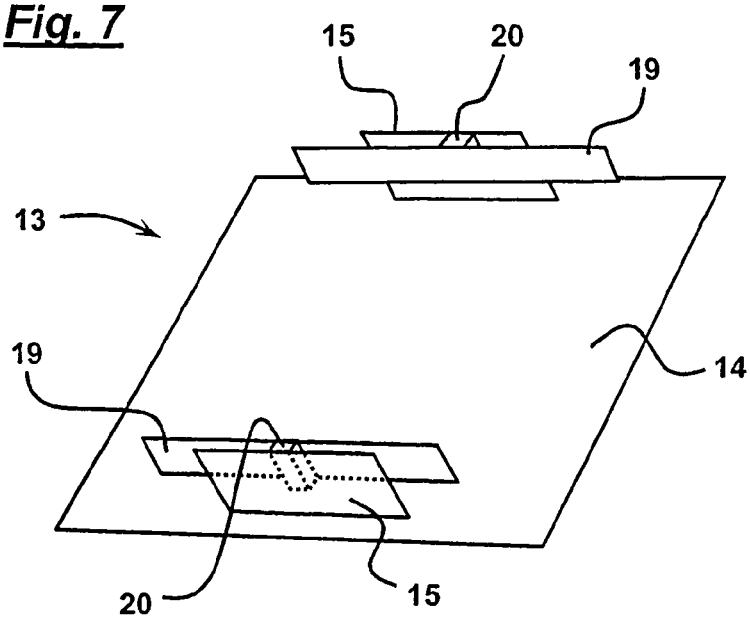
FIG. 7 is a perspective view of a third embodiment of bending wave panel loudspeaker of the invention.

In the embodiment of FIG. 7, there is shown a perspective view of a two channel panel-form bending wave loudspeaker (13) which is generally similar to those of FIG. 6, but using short lever couple flanges (15). Thus the levers are short in relation to the length of the bending wave panel radiator (14) to which they are fixed.

Figure 8:
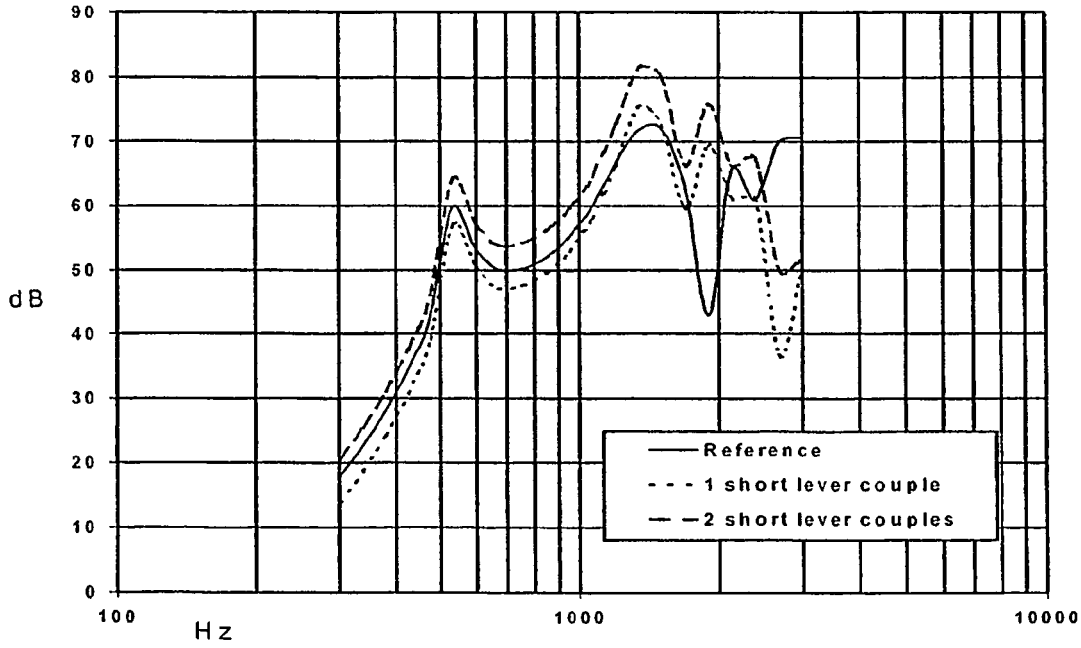
FIG. 8 is a graph plotting sound pressure with frequency and which comprises the output of a loudspeaker of the FIG. 2 device with loudspeakers of the invention.

FIG. 8 is a graph of sound pressure versus frequency showing a continuous reference trace which is for the prior art speaker as shown in FIG. 2, trace 1 [long dash] which is for a single short length lever couple, and 2 [short dash] which is for the loudspeaker diaphragm fitted with two exciters driving via individual short length lever couples, e.g. as shown in FIG. 7. Here the drive signal is common to show the positive summation of the energy contributions corresponding to the embodiment of FIG. 7.

Figure 9:
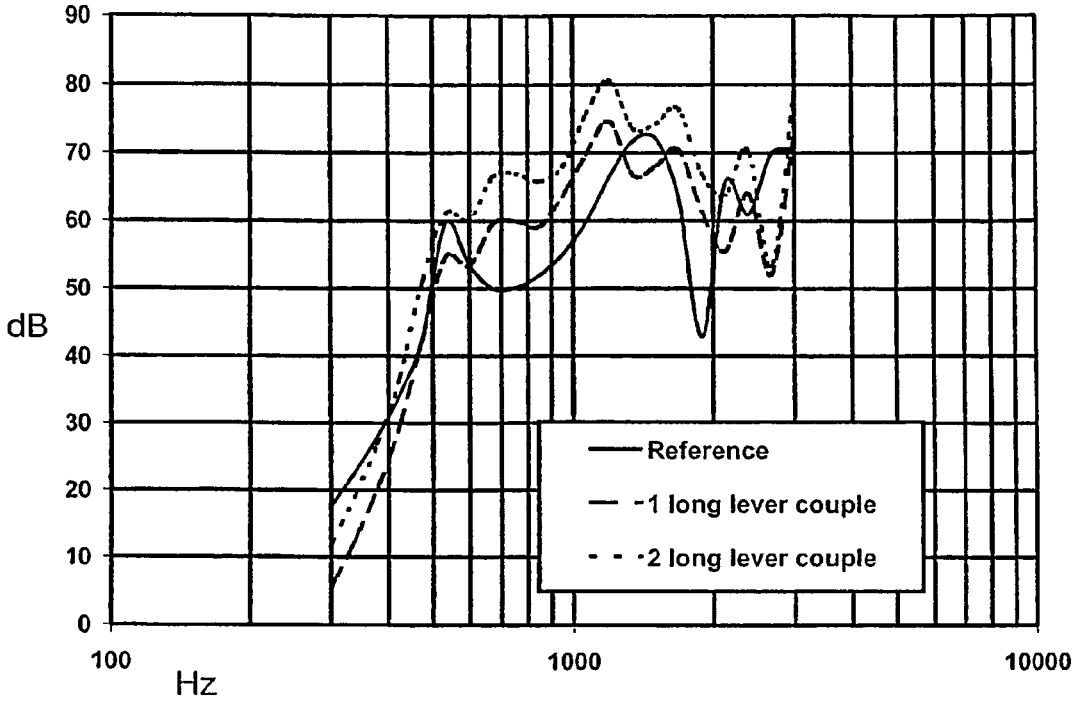
FIG. 9 is a graph plotting sound pressure with frequency and comprising the prior art speaker of FIG. 2 with that of FIG. 6.

FIG. 9 is a graph of sound pressure versus frequency showing a continuous reference trace for the prior art bending wave loudspeaker panel of FIG. 2. Also shown is the sound output provided by long lever couple for a single channel trace 1 [long dash] and for two channels operated in phase [short dash], the long levers being of the kind shown in FIG. 6. Improvements may seen in both the power/loudness of the embodiment and the uniformity of response. Good power integration is seen for dual lever couple working.

Figure 10:
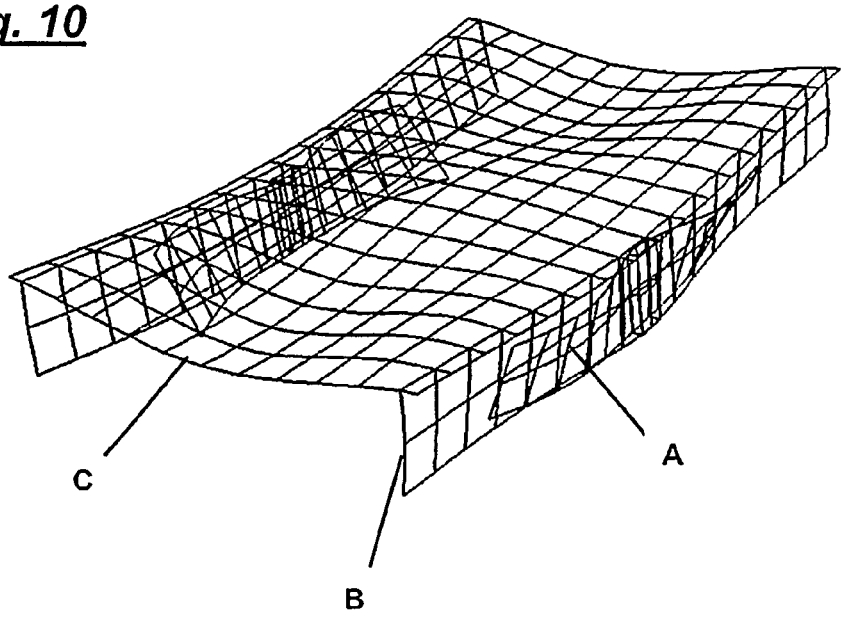
FIG. 10 is a perspective graphic representation of a bending wave panel speaker of the invention in operation.

FIG. 10 is a wire mesh representation of the bending wave action for a speaker panel (14) of the invention which has three distinguishable sets of modes contributing useful sound pressure. Smaller audio devices employing bending wave acoustic panels have a consequently lower modal density and higher mechanical impedance than larger devices. It is therefore desirable to make available additional modal sets to compensate. The first mode set A may be defined by the design of the modal actuator, e.g. a piezo DMA. The second mode set B may be designed as part of the lever couple, which in this case is intentionally not perfectly or practically rigid. Mode set three C is obtained from the intended resonant bending wave behaviour of the loudspeaker radiating panel element. Each component may be adjusted, for example using vibrational analysis tools to provide useful co-operative resonant working to achieve good acoustic results.

Figure 11:
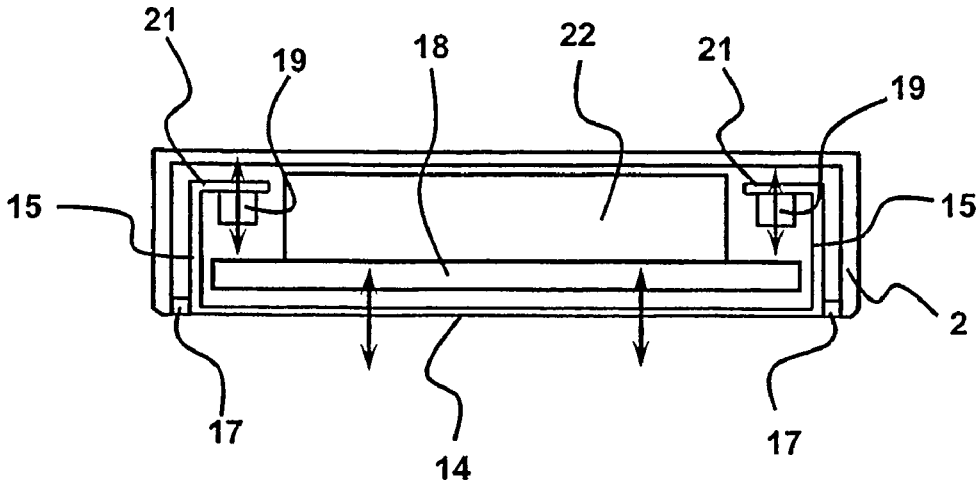
FIG. 11 is a cross-sectional side view of a small electronic device, e.g. a mobile telephone or PDA incorporating a bending wave panel speaker of the invention.

FIG. 11 shows yet another embodiment of small electronic device, e.g. a phone (1) or a PDA (11), which is generally similar to that of FIG. 6 and incorporating a panel-form speaker (13) formed by a transparent cover (14) over a visual display (18), where two or more exciters (19) may be used with a modified lever couple member (15) to add a component of whole body or in phase motion in the lower frequency range. The lever couple flange (15) is taken through another right angle at its free end to form a return flange (21). This allows the exciters (19) to move normal to the plane of the radiator. At lower frequencies due to inertial reaction, and/or if the exciter is grounded to a frame section, the panel (14) moves as a whole, at frequencies below the resonant bending wave range of the panel. At higher frequencies there is a transition to bending wave action as the lever couple begins to convert the motion of the exciter into bending forces at the perimeter of the sound panel. At high frequencies bending wave action predominates.

Figure 12:
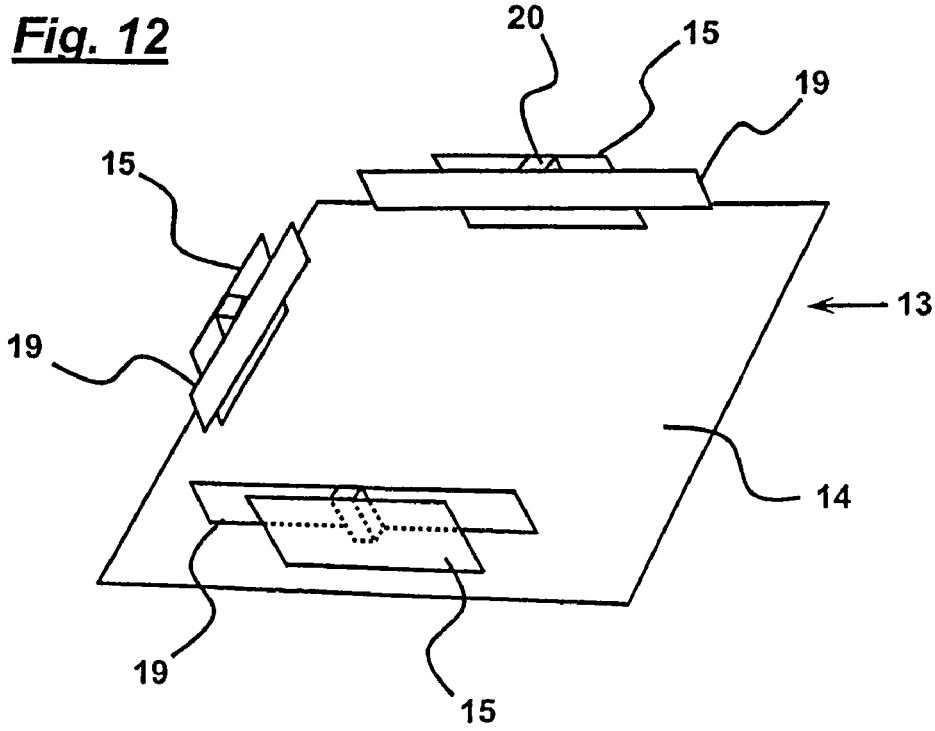
FIG. 12 is a perspective view of a yet further embodiment of bending wave panel speaker of the invention.

In FIG. 12 there is shown an embodiment similar to that of FIG. 7 and using three lever couple flanges (15) to extend the device to multi-channel use. In this example left and right channel loudspeaker output for a PDA has been augmented by excitation in the cross axis, representing a centre channel. Such would be appropriate for a personal video player with three main sound channels. More lever couple and exciters may added as appropriate, the bending wave screen usefully summing the various contributions.

Figure 13:
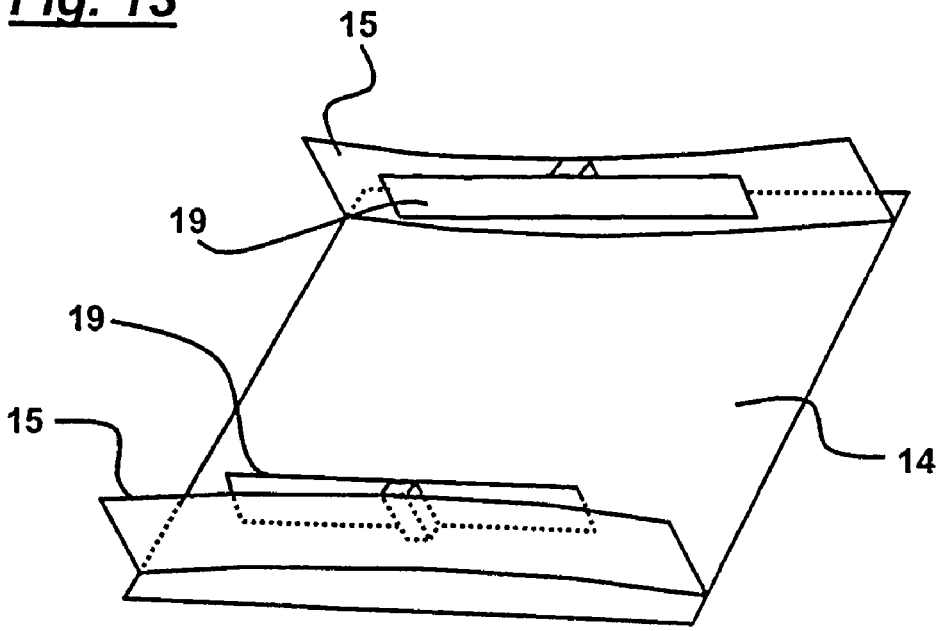
FIG. 13 is a perspective view of another embodiment of bending wave panel speaker of the invention.

FIG. 13 is an embodiment generally similar to that of FIG. 6 with the lever coupler flanges (15) curved in three dimensions.

Figure 14:
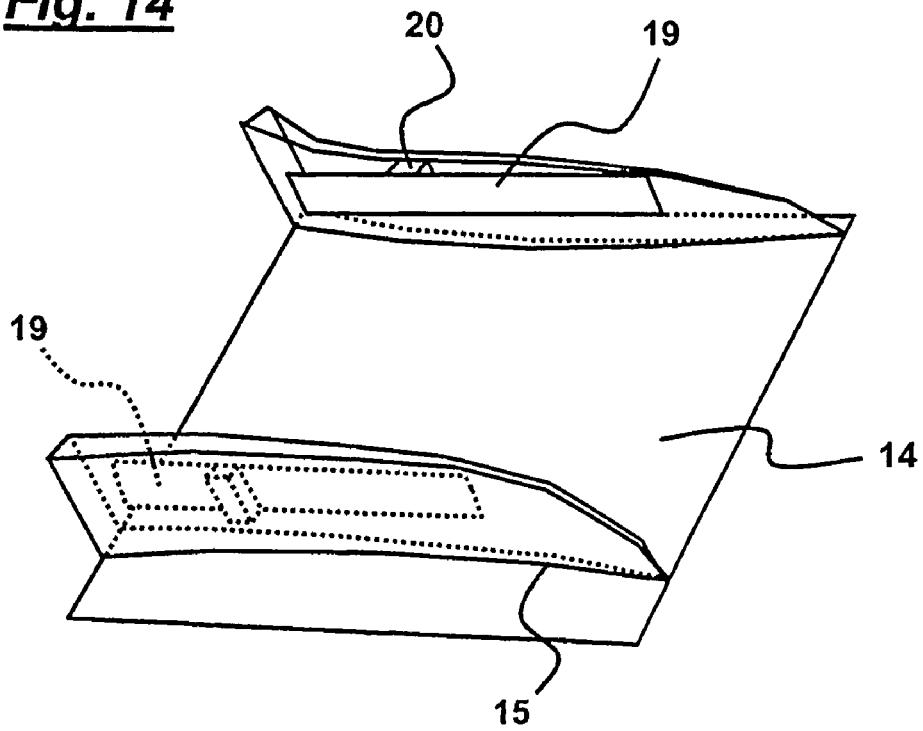
FIG. 14 is a perspective view of a still further embodiment of bending wave panel speaker of the invention.

FIG. 14 is an embodiment based on that of FIG. 6 and showing that the speaker of the invention is not restricted to symmetrical configurations, and that further refinements may be achieved using the additional degrees of freedom conferred by off centre location of the DMA or equivalent exciter (19) on the fixing stub (20), the offset of the stub (20) and height relative to the lever coupler, the location height and length of the couple, its peripheral location relative to the panel edge, the shape and thickness of the lever coupler, whether the coupler have a curved profile in a plane, i.e. three dimensions. These features are shown in general in this Figure.

Unexpected benefits include improved low frequency performance and the fact that the overall bending object can be larger due to presence of levers, leading to slightly lower $f_o$ and increased density.

The results of simulations show that the new compact solution provides at least equivalent performance to the outboard conventional solution, with greatly reduced space requirement, permitting additional degrees of design freedom.

Another benefit is in further gains in sound quality due to increased modal density for the system as a whole.

Also, within the same footprint a second channel may be added for stereo.

Useful channel separation is observed from the mid-band (1 kHz) and upwards, while below 1 kHz, the potential for increased efficiency and response improvement has been demonstrated.

There is also potential for pistonic augmentation, i.e. whole body non-rocking translation of the lower frequency range added to the bending wave drive, particularly below the fundamental bending mode of the combined radiating panel and lever structure ($f_o$). This may be achieved by forming the lever with a secondary flange or other rigidly attached return member extending generally parallel to the plane of the panel and coupling the exciter(s) to the flange or the like, whereby force is applied by the exciter by the lever substantially normal to the plane of the panel.

The invention claimed is:

1. A method of making a bending wave panel loudspeaker, comprising:

rigidly coupling a lever to a panel marginal portion to define a region where a suspension can be attached and wherein the lever extends at an angle to the plane of the panel, providing the lever with a return lip at its end remote from the panel, coupling a vibration exciter to the return lip whereby bending wave energy is coupled to the panel to provide an acoustic output when the exciter is fed with a signal, and supporting the panel on a suspension positioned outboard of the lever in said region with said suspension being adapted to provide boundary conditions which improve performance.

2. A method according to claim 1, comprising arranging the lever to be in the form of a flange extending along a marginal portion of the panel.

3. A method according to claim 2, comprising arranging the flange to extend part-way along the marginal portion.

4. A method according to any one of claims 1 to 3, comprising arranging levers or flanges on a pair of opposite marginal portions of the panel, each lever or flange having a respective return lip, and coupling each return lip to a respective vibration exciter whereby the panel can be operated as a stereo device.

5. A method according to claim 4, comprising arranging a lever or flange on an adjacent marginal portion of the panel, and coupling a vibration exciter to the lever or flange on the adjacent edge or marginal portion to provide a multiple channel acoustic output.

6. A method according to claim 1, comprising driving the lever into resonance by the associated vibration exciter.

7. A method according to claim 6, comprising selecting a distributed mode device as a vibration exciter.

8. A method according to any one of claims 1 to 3, comprising positioning the exciter inboard of the lever or flange.

9. A method according to any one of claims 1 to 3, wherein the vibration exciter applies force to the return lip generally in the plane of the panel.

10. A method according to any one of claims 1 to 3, wherein the vibration exciter applies force to the return lip generally normally to the plane of the panel.

11. A method according to any one of claims 1 to 3, wherein the panel is driven into resonance by the exciter.

12. A method according to claim 11, wherein the resonance is of the distributed mode kind.

13. A bending wave panel-form loudspeaker comprising:

a panel, a lever rigidly coupled to a marginal portion of the panel to define a region where a suspension can be attached, a return lip on the lever at its end remote from the panel, a vibration exciter coupled to the return lip to apply bending wave energy to the panel to produce an acoustic output, and a panel suspension positioned outboard of the lever in said region with said suspension being adapted to provide boundary conditions which improve performance.

14. A loudspeaker according to claim 13, wherein the lever is in the form of a flange extending along the marginal portion of the panel.

15. A loudspeaker according to claim 14, wherein the flange extends part-way along the marginal portion.

16. A loudspeaker according to any one of claims 13 to 15, wherein levers or flanges are provided on a pair of opposite marginal portions of the panel, each lever or flange having a respective return lip and being coupled to a respective vibration exciter whereby the loudspeaker may be operated as a stereo device.

17. A loudspeaker according to claim 16, wherein a lever or flange is provided on an adjacent marginal portion of the panel, the lever or flange on the adjacent marginal portion being coupled to a vibration exciter to provide a multiple channel acoustic output.

18. A loudspeaker according to any one of claims 13 to 15, wherein the lever or flange is adapted to be driven into resonance by the associated vibration exciter.

19. A loudspeaker according to claim 18, wherein the vibration exciter is a distributed mode device.

20. A loudspeaker according to any one of claims 13 to 15, wherein the exciter is placed inboard of the lever or flange.

21. A loudspeaker according to any one of claims 13 to 15, wherein the vibration exciter is adapted to apply force to the return lip generally normal to the plane of the panel.

22. A loudspeaker according to any one of claims 13 to 15, wherein the vibration exciter is adapted to apply force to the return lip generally in the plane of the panel.

23. A loudspeaker according to any one of claims 13 to 15, wherein the panel is adapted to be resonant to produce an acoustic output.

24. A loudspeaker according to claim 23, wherein the panel is of the distributed mode kind.

25. A small electronic device having a display screen, and a transparent protective cover over the display screen, wherein the transparent protective cover is a loudspeaker as claimed in any one of claims 13 to 15.

26. A small electronic device according to claim 25, wherein the device is a mobile telephone, PDA or the like.

27. A bending wave panel-form loudspeaker having:

a panel;

a lever rigidly coupled to an edge of the panel, said lever having a return member extending generally parallel to the plane of the panel at its end remote from the panel;

a vibration exciter coupled to the return member of the lever to apply bending wave energy to the panel to produce an acoustic output; and a panel suspension positioned outboard of the lever.

* * * * *